United States Patent [19]

Ooms

[11] Patent Number: 4,849,669

[45] Date of Patent: Jul. 18, 1989

[54] ELECTRIC INCANDESCENT LAMP FOR OPERATION AT LINE VOLTAGE

[75] Inventor: Leo F. M. Ooms, Turnhout, Belgium

[73] Assignee: U.S. Philips Corporation, New York, N.Y.

[21] Appl. No.: 122,983

[22] Filed: Nov. 19, 1987

[30] Foreign Application Priority Data

Nov. 28, 1986 [NL] Netherlands ..... 8603035

[51] Int. Cl.[4] ..... H01K 1/38; H01K 1/40

[52] U.S. Cl. ..... 313/318; 313/623; 313/315

[58] Field of Search ..... 313/318, 332, 623, 578, 313/315

[56] References Cited

U.S. PATENT DOCUMENTS 3,548,245 12/1970 Biscoff ..... 313/623 X

*Primary Examiner*—Kenneth Wieder

[57] ABSTRACT

The electric incandescent lamp for operation at line voltage has a glass lamp vessel (1) provided with a pinched seal (5), in which a metal foil (9) is embedded, which is connected to an internal current conductor (14) extending to a filament (4). The major surfaces (7, 8) of the pinched seal (5) have above the internal current conductor (14) an embossed part (17, 18), as a result of which a space (23) is present in the pinched seal (5) on either side of said current conductor (14). Depressions (19–23) increase the resistance to pressure of the lamp vessel (1). A discharge arc that can be produced in the lamp extinguishes when the arc has reached the pinched seal (5) if the internal current conductor (14) has a wire diameter of at most 200 μm.

7 Claims, 1 Drawing Sheet

ELECTRIC INCANDESCENT LAMP FOR OPERATION AT LINE VOLTAGE

The invention relates to an electric incandescent lamp for operation at line voltage.

British Pat. No. 2,027,416 discloses a glass lamp vessel having a helically wound filament in a sealed cavity. The vessel has at one end a pinched seal with two major surfaces and a metal foil embedded therein parallel to a major surface, and connected to an external conductor. An internal conductor connecting the filament to the metal foil is partially free from the glass in the pinched seal.

The known lamp has within the pinched seal a second cavity in which the part of the internal current conductor located in the cavity is on all sides free from the glass of the pinched seal. This second cavity becomes manifest in that the surface of the pinched seal has an embossed part, i.e. a fold, which extends at right angles to the internal current conductor. The cavity of the lamp vessel in which the filament is situated communicates through a narrow duct with the second cavity in the pinched seal in that the internal current conductor, after the pinched seal has been provided at an elevated temperature, shrinks to a greater extent than the glass of the pinched seal.

Due to the construction of its pinched seal, the known lamp has the property that a discharge arc, which may be formed when the filament breaks and which is capable of melting away the fragments of the filament and the internal current conductor, extinguishes in time. Although no additional components are used for assembling the lamp, the lamp nevertheless has the function of an incorporated fuse.

It is important that an incandescent lamp has an incorporated fuse because the lamp is often used in luminaires not provided with a fuse. In a lamp without an incorporated fuse, when a discharge arc is produced after the filament has broken at the end of the life of the lamp the current through the lamp can increase to such an extent that the lamp explodes or that the fuse of the equipment connected to the lamp melts.

The known lamp is time-consuming to manufacture because the second cavity in the pinch can be evacuated and cleaned only with great difficulty due to the fact that this space is accessible only through a narrow duct from the cavity in which the filament is arranged.

Another disadvantage is that the manufacture of the lamp requires pinch blocks, which results in a distinctly different profile of the pinched seal. Consequently, for the manufacture of lamps which do not require a fuse function and which need not or must not have a strongly deviating pinch surface profile, other pinch blocks must be mounted on the production machine.

It should be noted that in DE GM No. 1952883 an incandescent lamp is described, in which the major surfaces of the pinched seal have above the internal current conductor an embossed part which has a width of twice the diameter of the conductor. A similar embossed part is provided above the external current conductor. These embossed parts together aim at preventing the metal foil from cracking when the seal is formed. Since the embossed parts are too narrow to result in a space on either side of the internal current conductor, a fuse function is not obtained for this lamp. Furthermore, the internal current conductor is a very thick wire on which a discharge arc is maintained like on an electrode. Since the discharge arc is maintained on the internal current conductors and fragments of the filament then fail, the arc current can increase to a very high value and the lamp can explode.

SUMMARY OF THE INVENTION

The invention provides a lamp which not only incorporates a fuse without the use of additional components, but can also be realized very simply and rapidly and can be manufactured with standard pinch blocks, which can be used also for other lamp types, such as low-voltage lamps.

According to the invention, the major surfaces of the pinched seal have above the internal current conductor an embossed part extending from the part of the lamp vessel enclosing its cavity beyond the second end of the metal foil and having a width which is a multiple of the diameter of the internal current conductor. The internal current conductor has a wire thickness of at most approximately 200 μm.

Due to the embossed part on the major surfaces of the pinched seal, a space is present in a plane parallel to the major surfaces laterally of the internal current conductor on either side thereof, as a result of which the current conductor is free on both sides from the glass of the pinched seal. In a plane through the internal current conductor at right angles to the major surfaces, the glass is generally in contact with the current conductor in spite of the embossed parts. It has been found that this geometry results in a discharge arc being extinguished, after melting away the fragments of the filament and the internal current conductor, and reaching the pinched seal.

The lamp has a fuse function which is very reliable, although no additional components are required to realize this function. The modification of the pinched seal required for this function is moreover very small so that the pinch blocks can be used for many types of lamps. The lamp has a simple construction, which can be rapidly and readily realized. The lamp vessel can be readily evacuated and cleaned during the manufacture of the lamp, i.e. more readily than in the case of a conventional lamp without a fuse function and more readily than in the case of a lamp according to British Pat. No. 2,027,416. This can be explained as follows.

Due to the very small expansion coefficient of the glass of the lamp vessel, an internal current conductor, which in fact has a considerably higher expansion coefficient, cannot be embedded in a pinched seal in a vacuum-tight manner. A narrow duct extending beyond the weld of the current conductor to the metal foil is always present along the current conductor. However, this duct is so narrow that the current conductor in fact touches the glass of the pinched seal. In conventional lamps during its manufacture, volatile constituents have also to be removed from this narrow duct. During the manufacture of such a lamp, even the second cavity in the pinched seal has to be evacuated via such a duct. In the lamp according to the invention, however, such a duct is comparatively wide in the plane through the metal foil due to the fact that there is a space in the plane on either side of the internal current conductor. This space can be observed very clearly by means of a magnifyingglass having a magnification of only six times.

The invention results in an increase of the gas pressure in the lamp vessel, at which the pinched seal is destroyed. Fatal gas pressures of 30 bar have been measured. However, during operation of the lamp under normal conditions, such pressures are not reached. Nevertheless, because of a larger safety margin and a larger permissible spread, it is important to increase the gas pressure that can cause the pinched seal to be destroyed. Depressions are thus provided in the major surfaces of the pinched seal, these depressions adjoining the part of the lamp vessel enclosing its cavity and the embossed part of the major surfaces. With depressions of 0.2 mm under the surface of the major surfaces, an increase of the fatal gas pressure to at least 50 bar was found.

The measure according to the invention is especially important for line voltage lamps having a power of less than 1000 W. Lamps of higher powers have filaments of wire having such a thickness that a discharge arc does not melt away the wire. The fragments of the filament thus remain connected in series with the discharge arc which may be formed and consequently limit the arc current. In such lamps, an incorporated fuse is therefore not required.

The embossed part on the major surfaces of the pinched seal must have a considerable width in order to achieve that a space is formed on either side of the internal current conductor. This width is related to the diameter of the internal current conductor. When this internal current conductor is a single coil end of a coiled coil filament, the minimum width of the embossed part is larger than when the internal current conductor is a straight wire end of the wire from which the filament is wound. The width of the embossed part should be a multiple of the diameter of the internal current conductor, for example the quintuple or more. The embossed part generally projects above the surface of the major surfaces by a few tenths of a millimetre, for example 0.4 or 0.5 mm.

The internal current conductor may be an end of the filament that may be helically wound. On the other hand, the internal current conductor may be a separate body fitting into or arranged to surround the filament. To prevent the internal current conductor from acting as an electrode for a discharge arc, the current conductor has a wire thickness of at most approximately 200 μm.

The lamp according to the invention may have two pinched seals with a metal foil embedded in each of them or one pinched seal with two metal foils embedded therein. In these two cases, respective embossed parts can be present only above one of the two or above each of the two internal current conductors on the major surfaces of the pinched seal(s).

The lamp may be filled with a gas containing halogen.

DETAILED DESCRIPTION OF THE PREFERRED EMBODIMENT

Figure 1:
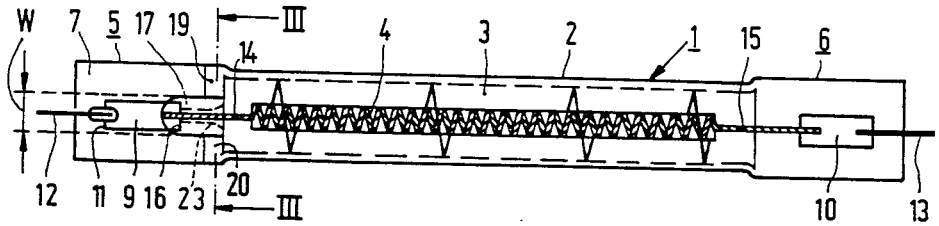
FIG. 1 is a side elevation of a lamp.
Figure 2:
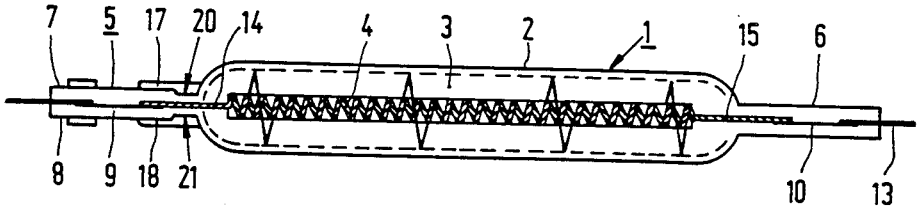
FIG. 2 is a side elevation of the lamp shown in FIG. 1 rotated through 90°.

In the Figures, the lamp has a lamp vessel 1 of glass, which is sealed in a vacuum-tight manner. The glass has an $SiO_2$ content of at least 95% by weight; it consists, for example, of quartz glass. The lamp vessel 1 has a part 2 enclosing a cavity 3, in which a helically wound filament 4 is arranged, and having at an end a pinched seal 5. The lamp shown has a second pinched seal 6. The pinched seal 5 has two major surfaces 7, 8.

A metal foil 9 (10), for example of molybdenum, is embedded in the pinched seal 5 (6) parallel to the major surfaces 7, 8. At a first end 11, the foil 9 (10) is connected to an external current conductor 12 (13), for example of molybdenum, which emanates from the pinched seal 5 (6).

An internal current conductor 14 (15), in the drawing an single coil limb of the coiled coil tungsten filament 4 connected to filament 4 and extending from the cavity 3 into the pinched seal 5 (6), is welded to the foil 9 (10) at the second end 16 thereof. The internal current conductor 14 is in the pinched seal 5 partially free from the glass of this seal.

The major surfaces 7, 8 of the pinched seal 5 have above the internal current conductor 14 an embossed part 17, 18, which extends from the part 2 of the lamp vessel 1 enclosing the cavity 3 to beyond the second end 16 of the foil 9 and has a width w (FIG. 1), i.e. a dimension transverse to the internal current conductor 14, which is a multiple of the diameter of the internal current conductor 14. The internal current conductor 14 has a wire thickness of at most 200 μm.

The major surfaces 7, 8 of the pinched seal 5 have depressions 19, 20, 21, 22, which adjoin the part 2 of the lamp vessel 1 enclosing its cavity 3 and the embossed part 17, 18 of major surfaces 7, 8.

Figure 3:
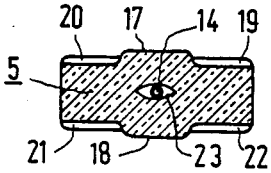
FIG. 3 shows a cross/section taken on III—III in FIG. 1.

FIG. 1 indicates that the internal current conductor 14 has in a plane parallel to the major surfaces 7, 8 on both sides a space 23, which narrows from the cavity 3 (cf. also FIG. 3).

A lamp having the shape shown in the Figures consumed at 220 V a power of 500 W. The lamp had a filling of 2.5 bar of Ar and 1.5% by volume of $CH_2Br_2$. The internal current conductors were constituted by the single coil limbs of the coiled coil filament and had a diameter of 433 μm and a wire thickness of 121 μm.

Embossed parts 17, 18 having a width w of 4 mm were situated above the internal current conductor 14 on each of the two major surfaces 7, 8 of the pinch. Each embossed part projected above the surface of the pinched seal by approximately 0.4 mm. On either side of the embossed parts, a depression 19, 20, 21, 22 was present having a depth of approximately 0.2 mm.

In an experiment half of the filament was shortcircuited. The lamp was operated for 60 seconds at 150 V, after which the voltage was suddenly increased to 260 V. The non-shortcircuited part of the filament burned through and a discharge arc was obtained. In all cases (28 lamps), the arc extinguished within 10 ms. In lamps without the measure according to the invention, an explosion always followed under the same conditions. In the test lamps, the distance between the end 16 of the metal foil 9 and the cavity 3 of the lamp vessel 1 varied from 2.5 to 6.5 mm.

Lamps of the kind shown in the drawing, but having a single coil filament having internal current conductors constituted by straight limbs of the filament (wire diameter 164 μm), were intended to consume a power of 500 W during operation at 120 V. During normal operation, either an internal current conductor or the filament was molten by means of a laser. The discharge arc then produced extinguished when the pinched seal was reached without explosion occurring.

What is claimed is:

1. An electric incandescent lamp for operation at line voltage comprising:

a glass lamp vessel sealed in a vacuum-tight manner, having a part enclosing a cavity in which a helically wound filament is arranged and having at an end a pinched seal which has two major surfaces said vessel having a space extending from said cavity into said pinched seal, the glass containing at least 95% by weight of $SiO_2$, a metal foil embedded in said pinched seal parallel to the major surface thereof and having a first end connected to an external current conductor emanating from the pinched seal, an internal current conductor connected to said filament and extending into the space and welded to the metal foil at a second end thereof, said internal current conductor being closely received in the space partially free from the glass of the pinched seal, each of the major surfaces of the pinched seal having above the internal current conductor an embossed part extending from the part of the lamp vessel enclosing its cavity to beyond the second end of the metal foil and having a width which is a multiple of the diameter of the internal current conductor, the internal current conductor being free from the glass of the pinched seal on either side thereof in the direction of the width, the internal current conductor having a wire thickness of at most approximately 200 μm.

2. An electric lamp as claimed in claim 1, characterized in that the major surfaces of the pinched seal have depressions which adjoin the part of the lamp vessel enclosing its cavity and the embossed part of said major surfaces.

3. An electric lamp as in claim 1 wherein the internal conductor is a single coil wire.

4. An electric lamp as in claim 1 wherein said space has an elongate cross section whose longest dimension parallels said major surfaces.

5. An electric lamp as in claim 4 wherein said internal current conductor is in contact with said lamp vessel transversely of said longest dimension.

6. An electric lamp as in claim 1 wherein said space extends to said metal foil.

7. An electric lamp as in claim 1 wherein the width of the glass in the embossed part is at least five times the diameter of the internal current conductor.

* * * * *